US005289753A

United States Patent [19]

Rieckhoff

[11] Patent Number: 5,289,753

[45] Date of Patent: Mar. 1, 1994

[54] LIGATURE FOR REED INSTRUMENT

[76] Inventor: Gustav J. Rieckhoff, 620 N. 28th St., Quincy, Ill. 62301

[21] Appl. No.: 986,703

[22] Filed: Dec. 8, 1992

[51] Int. Cl.[5] ..... G10D 9/02

[52] U.S. Cl. ..... 84/383 R

[58] Field of Search ..... 84/383 R, 398, 376, 84/379

[56] References Cited

U.S. PATENT DOCUMENTS

| | | | |
|---|---|---|---|
| 3,205,753 | 9/1965 | Luyben | 84/383 R |
| 4,080,866 | 3/1978 | Toof | 84/383 R |
| 4,941,385 | 7/1990 | Johnson | 84/383 R |
| 5,000,073 | 3/1991 | Hite | 84/383 R |

*Primary Examiner*—Michael L. Gellner
*Assistant Examiner*—P. Stanzione
*Attorney, Agent, or Firm*—Joseph W. Holloway

[57] ABSTRACT

A split ring pliant ligature for the mouthpiece of a reed instrument displays a pair of longitudinally spaced straps including lateral arms attached to a medial bottom span. A thumbscrew mechanism attached to the joined ends of the arms draws the straps compressively about the mouthpiece and a reed shank. Transversly spaced members bridge the bottom spans and carry pads which project radially inwardly therefrom to contact the mouthpiece on both sides of the reed's shank. The pliant bottom spans provide the sole compressive contact between the ligature and the reed shank. The configuration of the ligature and its resilience causes the tensile force generated by the thumbscrew to be distributed generally evenly between the two bottom spans bearing upon the reed shank.

8 Claims, 2 Drawing Sheets

LIGATURE FOR REED INSTRUMENT

BACKGROUND OF THE INVENTION

This invention generally relates to an improved ligature for securing a reed to the mouthpiece of a single reed woodwind instrument.

The field of endeavor of this invention is old and well developed. Numerous reed instruments have been devised throughout history and their modern counterparts have changed little in essential structural and operational characteristics. Likewise, the below-listed criteria of instrument builders and musicians regarding ligature means have not changed significantly:

1. The ligature must be mechanically competent to position and retain the reed in proper juxtaposition to the mouthpiece;
2. The ligature should facilitate easy attachment and careful adjustment of the reed relative to the mouthpiece;
3. The ligature must embrace the reed and mouthpiece with sufficient radial compression to perform its reed-retention function while, at the same time, permitting the development of those vibratory characteristics of the reed-mouthpiece-ligature assembly most productive of the fuller, richer, mellower sounds highly desired by instrumentalists;
4. The compressive forces imparted to the reed and mouthpiece when operatively embraced by the ligature should be distributed in a manner that does not inhibit the beneficial vibrational coaction of the reed-mouthpiece-ligature assembly; and
5. The degree of surface engagement between the ligature and the reed should not cause excessive damping of the sound emanating from the reed and mouthpiece.

Early ligatures, as the word suggests, comprised a length of stout string wrapped continuously about the reed and mouthpiece. Such string ligatures provided satisfactory mechanical means for retaining the reed in its mounted position upon the mouthpiece. Many modern musicians believe that the yieldability and resilience of such string ligatures facilitated the production of superior tone, timbre and responsiveness which established the standards in these catagories. Indeed, this ancient method of reed retention is employed yet today with respect to certain double reed instruments. Despite the fact that string ligatures do satisfy most of the five criteria listed hereinabove, they have fallen into general disuse with respect to single reed instruments due to the considerable time required to handwind the string properly about the reed and mouthpiece and because such ligatures do not allow quick and easy adjustment and replacement of reeds. Moreover, the wrapping technic required for successful use of string ligatures cannot be readily mastered by beginning, usually youthful, instrumentalists.

For the reasons just stated, split ring ligatures made of thin, light metal have generally replaced string ligatures, at least with respect to single reed instruments such as clarinets and saxophones. This well-known ligature device typically includes one or more thumbscrews penetrating threaded bores through the opposed ends of metallic rings or bands for drawing these ends together whereby the rings unyieldably embrace the reed and mouthpiece to secure the same in assembled relation with considerable compressive force. Contrary to the difficulties encountered with string ligatures in assembling and accurately adjusting the reed to the mouthpiece, the split ring-thumbscrew construction greatly simplifies these tasks for both professional musicians and inexperienced players.

Even though the split ring ligature has become very popular, many instrumentalists detect a noticeable reduction in tone quality compared to the mellowness and fullness produced with a string wound ligature. Most investigators of this problem have concluded that unyielding metallic split ring ligatures produce clamping forces which act upon both the mouthpiece and the reed in a deleterious manner. Some posit that compressive forces produced by this ligature inherently diminish the free vibration of the reed and mouthpiece. Others believe that poorly situated, localized points of contact between the ring ligature and the reed and mouthpiece contribute to the tinny and unsteady tone produced. Some reason that the ligature ring or rings stress the reed shank unequally or non-homogeneously whereby excessive unit pressures acting only upon certain segments of the reed degrade instrument performance.

The proposed remedies for the recognized loss of tone quality encountered by split ring ligature users have been at least as plentiful and varied as the aforerecited theories regarding the causes of this problem; and, numerous remedial ligature constructions have been described in a substantial body of prior art. For example, prior United States patents disclose various resilent materials mechanically retained between a split ring ligature and a reed embraced thereby to cushion and/or equalize the reed vibration damping pressure exerted by the ligature. U.S. Pat. Nos. 1,575,621 (rubber); 1,801,421 (cork, felt, rubber); 2,292,584 (felt strips); 2,648,246 (resilient metal); 4,428,271 (mechanical spring, elastomeric or plastomeric material); 4,941,385 (sound vibration insulation such as foam rubber and pliable plastic).

Many prior art split ring devices have been structrually modified to minimize ligature contact with the reed and/or to provide ligature-to-reed contact only at certain selected locations in the belief that the reed was thereby rendered more free to vibrate whereby better tone and/or quicker response were provided. U.S. Pat. Nos. 2,791,929 (essentially line contact between two longitudinally extending, raised bars spaced near the longitudinal centerline of the reed); 2,837,003 (point contact only intermediate the ends of the reed away from its lateral edges); 3,410,170 (ligature has raised longitudinally extending bars each bar having spaced lands for contacting the reed); 4,080,866 (ligature has transverse bars extending across the reed and contacting the same only at its longitudinal centerline); 4,745,838 (longitudinally extending shoulders are raised on the interior ligature wall and provide line contact with the reed along the longitudinal edges thereof); 4,941,385 (the ligature carries a plate having raised longitudinally extending rails in line contact with the convex reed surface); 5,000,073 (a pair of longitudinally spaced, circumferential ribs project radially inwardly from the ligature wall to provide the sole clamping contact with the reed).

After metallic split ring ligatures were introduced, attempts were made to modify this basic ligature construction so that it could yieldably retain the reed upon the mouthpiece more in the manner of a string ligature. An early U.S. Pat. No. 555,561 to Cadwallader shows an alternative ligature which suggests split metal brackets between which a length of stout cord is interwoven. Thumbscrews draw the brackets together to cause the cords to embrace the reed and mouthpiece in a yieldable fashion. A similar version of the Cadwallader ligature is disclosed in U.S. Pat. No. 4,258,604. In U.S. Pat. No. 2,483,327 the stout cord suggested by Cadwallader is replaced by a piece of flexible fabric which is gripped by rigid brackets movable by thumbscrews in the usual manner to draw the fabric compressively inwardly against the reed. Another attempt to approximate string ligature tone quality in a thumbscrew tightenable device is disclosed in U.S. Pat. No. 4,056,997 where a unitary plastic strip overlies most of the reed shank and compressivly surrounds a major portion of the outer circumferential surface of the mouthpiece.

None of the just described thumbscrew-actuated ligatures which are intended to embrace the reed and mouthpiece yieldably and to promote maximum vibration leading to the classic tonal qualities of a string ligature have been broadly accepted by reed instrumentalists. This is because these prior art ligatures place all or at least a major portion of the reed shank and mouthpiece surface in direct contact with some pliable material such as cord, nylon string, woven or knitted fabric, or plastic thereby damping or totally eliminating desirable vibrations and resonances with might otherwise be produced by a reed-mouthpiece-ligature assembly. Many players rate this class of yieldable ligature as unacceptable due to the production of overly dark, even dull tones throughout the entire range of the instrument.

Prior art split ring ligatures structurally similar to those typically fabricated of thin metal, but which are instead made of pliant plastic, would appear to combine advantageously the resilient reed clamping effect of a string ligature and the handiness of a thumbscrew clamping mechanism. Flexible and somewhat elastic strap portions of known plastic ligatures transversly overlie one or more segments of the reed shank and generally conform to the surface configuration of the shank when drawn into engagement therewith by the tightening action of one or more thumbscrews. Windows or cutout portions in the prior art plastic ligatures generally conform in area and shape to those of metallic split ring ligatures and serve to avoid the overly dark tones attributable to the yieldable ligatures of Cadwallader and others of that type discussed hereinabove.

Any of these prior art plastic ligatures might finally have brought together a flexible ligature and a thumbscrew tightener to provide superior tone quality as well as ease of operation; nevertheless, each has failed to do so to any substantial degree. Thus, U.S. Pat Nos. 3,205,753 to Luyben; 3,618,440 to Ratterree; and 4,275,636 to Van Doren disclose plastic strap-thumbscrew ligatures which have purposely incorporated structural features which largely eliminate the string ligature effect otherwise made available by the flexibility and resilence of their plastic straps. While each of these ligatures could have resiliently embraced the reed shank without the high compressive forces of its metallic counterpart, each appears to have deliberately added specific structure which creates deleterious unit pressure levels when the ligature is tightened. In this regard, the Luyben ligature displays four small projecting nodules providing the sole contact points with the reed. Ratterree's plastic ligature strap has two projecting bars which hold the reed in place with a minimum of surface contact; and, Van Doren shows two spaced plastic split rings formed with projecting ribs intended to limit the contact area between the ligature and the reed. Thus each of these plastic ligatures, displays some bort of protrusion in compressive engagement with the reed which produces highly localized stress in the reed leading to an undesirably bright, reedy tone throughout an instrument's entire range.

From the foregoing discussion, it appears that those pliant, split ring ligature constructions found in the prior art pertinent to this invention have failed to emulate the venerable string ligature because, in some cases, too much of the reed surface is overlain and constrained by the ligature body resulting in dull, overly damped tone characteristics, or because, in other cases, exaggerated efforts to reduce aggregate ligature-to-reed contact area produce bright, reedy tone characteristics.

SUMMARY OF THE INVENTION

The general object of this invention is to provide an improved split ring ligature which overcomes the aforementioned shortcomings of known pliant ligatures and which meets the previously listed criteria of musicians and instrument builders.

Another important aspect of this invention is the provision of a pliant split ring ligature which approaches the performance of a string ligature with respect to tone quality, timbre and responsiveness.

A more specific object is to provide a ligature construction for a reed-instrument that is fabricated of a suitably pliable plastic whereby the reed and mouthpiece are joined within a resilient embrace of the ligature in contrast with the rigid clamping action of metal devices intended for this purpose.

Another specific object is to provide a resilient split ring ligature construction having longitudinally spaced strap portions which laterally traverse the reed shank in full and intimate contact with the shank.

Yet another object is to provide a resiliently pliant ligature having two longitudinally spaced, relatively wide straps and a single thumbscrew adapted to create substantially equal tension in the straps as the ligature is tightened about the reed and mouthpiece.

A detailed object is to provide a ligature having special structural elements for controlling and distributing the compressive forces applied to the reed as a pair of spaced, resilient straps are drawn radially into engagement with the curved reed surface by a thumbscrew tightener. This object is realized in part by the provision of elongated pads on the ligature's inside surface which project radially in straddling relation to the reed shank for supporting the spaced ligature straps on subjacent surfaces of the mouthpiece. The combined effects of longitudinally spacing the reed engaging surfaces of the ligature straps and straddling the reed with strap supporting pads appears to be a favorable distribution of radially directed compressive forces acting from side to side across the reed shank and from end to end along the reed shank which at last affords string ligature tonal characteristics in a split ring ligature.

DETAILED DESCRIPTION OF THE INVENTION

Figure 1:
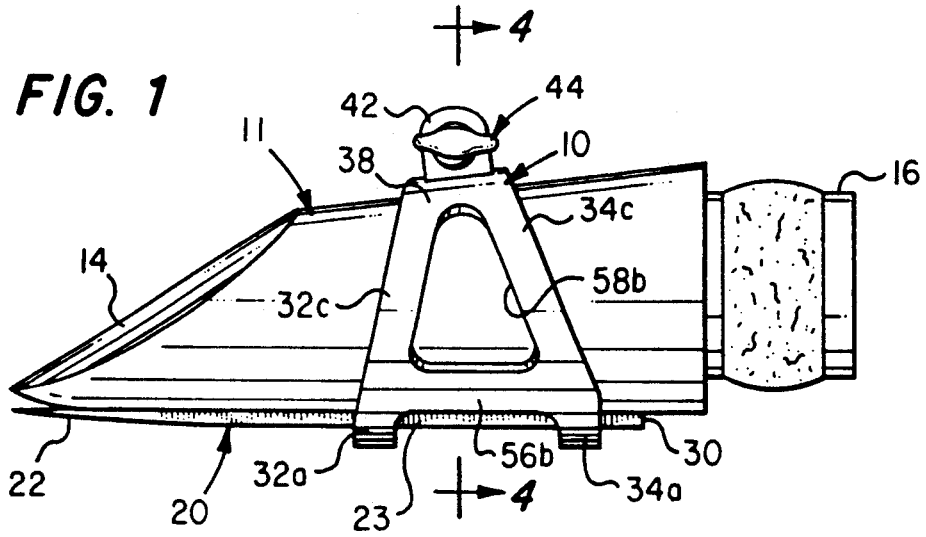
FIG. 1 is a side elevational view of a reed-mouthpiece-ligature assembly according to this invention.
Figure 2:
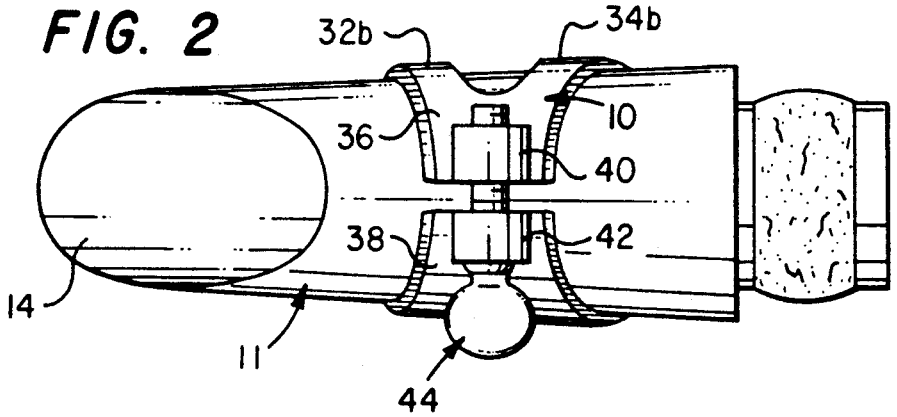
FIG. 2 is a top plan view.
Figure 3:
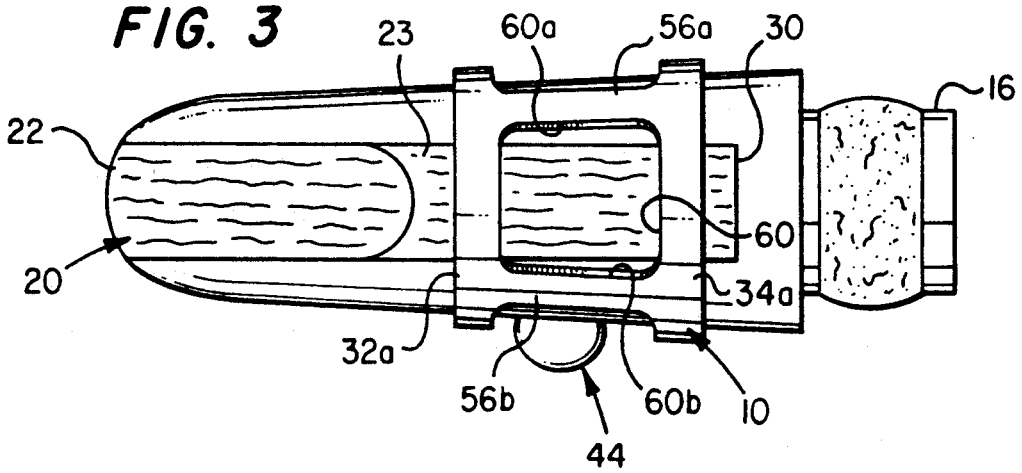
FIG. 3 is a bottom plan view.

The pliant ligature described herein and generally designated in the drawings by numeral 10 is intended to girdle a typical woodwind mouthpiece 11 that has a substantially cylindrical configuration, a bore 12, a beak 14 at its forward end, a gasketed tenon joint 16 at its rear end, and a relatively flat surface or table 18 on its underside. The illustrated reed 20 is conventionally constructed having a free forward portion 22 and a constrained shank portion 23 exhibiting sidewalls **24*a*, 24*b*, a flat mounting surface 26, a convex wall surface 28 and a heel 30. It will be readily understood that the function of ligature 10 is to position and hold the flat surface 26 of reed 20 against the table 18 of the mouthpiece 11**.

The ligature 10 in accordance with this invention is fabricated by injection molding or by otherwise forming a suitably flexible and resilient plastic material which affords certain parts of the ligature sufficient pliancy to follow closely the contours of the mouthpiece 11 and reed 20 while exhibiting sufficient tensile strength to avoid undue elongation or permanent deformation as the ligature is tightened by a thumbscrew mechanism. One of several plastic materials having these desirable physical properties as well as being inexpensive, lightweight and readily formed and worked by conventional means is polypropyline.

Figure 4:
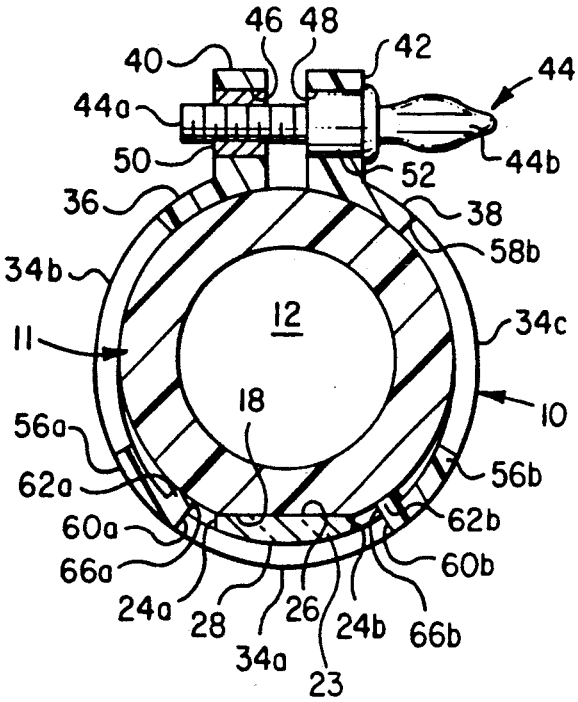
FIG. 4 is a sectional view taken generally along lines 4—4 of FIG. 1.
Figure 5:
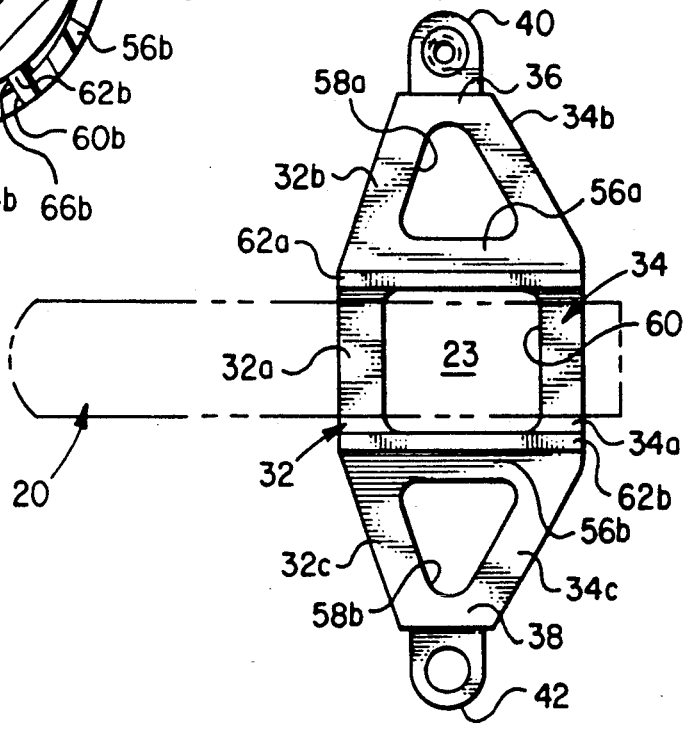
FIG. 5 is a plan view of the ligature shown in FIG. 1, which has been disassembled from the mouthpiece; and spread to its open condition; and, FIG. 6 is a side elevational view of the ligature shown in FIG. 5.
Figure 6:
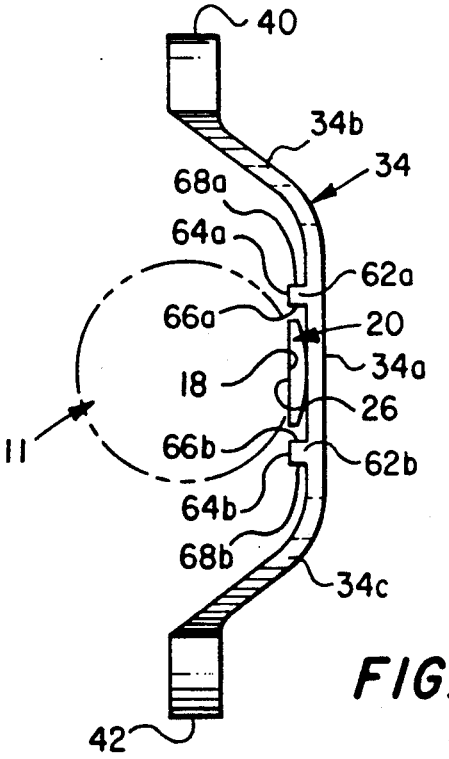

The general configuration of the ligature 10 will be best understood by having reference to FIGS. 5 and 6 where the depicted ligature has been removed from the mouthpiece 11 and spread laterally apart. Intended to lie transversly across the reed 20 are a front strap designated generally by numeral 32 and a rear strap designated generally by numeral 34 which jointly embrace the reed shank 23 and the slightly tapered body of the mouthpiece 11 in the manner shown in FIG. 4. Straps 32 and 34 have longitudinally spaced medial spans **32*a*, 34*a* connecting oppositely extending pairs of arms 32*b*, 34*b* and 32*c*, 34*c*. The arms of each pair slope toward one another and are joined at their intersecting ends by webs 36 and 38, respectively. Integrally formed with these webs and projecting radially therefrom are bosses 40 and 42 which receive therethrough a thumbscrew 44 to draw the bosses together thereby tightening the straps 32 and 34 about the mouthpiece and reed. As best shown in FIG. 4, the bosses have aligned transverse bores 46 and 48 therethrough. Bore 46 receives the thumbscrew's threaded distal end 44*a* in a threaded metallic insert 50; and, bore 48 receives an enlarged, shouldered end 52 of the thumbscrew for free rotation therein. The operation of the thumbscrew by means of a protruding fingergrip 44*b*** will be well understood by ligature users and need not be further described.

Located proximate the connections of the strap arm pairs **32*b*, 34*b* and 32*c*, 34*c* to the medial strap portions 32*a* and 34*a* are longitudinally extending bridges 56*a*, 56*b* having opposite ends integrally joined with the sloping arm pairs at their points of maximum separation to define generally triangular shaped windows or ports 58*a*, 58*a* through the opposite side walls of ligature 10. A generally rectangular port 60 through the bottom wall of the ligature is likewise defined by the intersection of the transverse medial strap portions 32*a*, 34*a* with the spaced bridges 56*a*, 56*b***.

A key structural feature of the present invention is the provision of a pair of raised pads or lugs **62*a*, 62*b* which project radially inwardly from the flat inside surfaces of the bridge elements 56*a*, 56*b* toward the underlying curved surface of the mouthpiece 11. As best shown in FIG. 4, these elongated pads are generally parallel and extend longitudinally along the proximate edges of bridge elements 56*a*, 56*b* which edges define opposing interior sidewalls 60*a*, 60*b* of the generally rectangular port 60. As will be hereinafter explained, a principal object of this invention is achieved in large part by making the width of port 60 somewhat wider than the transverse width of the shank portion 23 of a wooden or plastic reed intended to be secured to the mouthpiece by ligature 10 whereby the pads 62*a*, 62*b* projecting from bridge elements 56*a*, 56*b* straddle the reed shank 23 in the manner shown in FIGS. 4, 5 and 6. The pads 62*a*, 62*b* are integrally formed with the bridge elements which underlie them and have top walls 64*a*, 64*b*, proximate side walls 66*a*, 66*b*, and remote side walls 66*a* and 66*b* are planar continuations of the interior side walls 60*a*, 60*b* of the bottom port 60**.

OPERATION OF THE INVENTION

With the thumbscrew 44 extending through the bosses 40, 42, but not yet tightened, the ligature 10 may be slipped into girdling relationship about the mouthpiece 11 and reed shank 23 as shown in FIGS. 1–4 of the drawings. As the thumbscrew is rotated in a tightening direction the bosses are moved closer together thereby drawing the undersurfaces of the pliant front and rear straps or rings 32 and 34 into intimate contact with the somewhat tapered surface of the mouthpiece 11 and with the reed shank 23. As viewed in FIGS. 1 and 4, the upper portions of extending pairs of strap arms **32*b*, 34*b* and 32*c*, 34*c* are drawn radially inwardly against the outer surface of the mouthpiece while the medial strap portions 32*a*, 34*a* are pressed upwardly against the convex wall 28 of the reed. As this occurs the radially projecting lugs or pads 62*a*, 62*b* engage the lower mouthpiece surface on opposed sides of the reed shank 23** with the following important results:

1. A lower portion of each of the strap pairs **32*b*, 34*b* and 32*c*, 34*c* as well as the bridge elements 56*a*, 56*b*** are radially spaced from subjacent mouthpiece surfaces;
2. The medial strap portions **32*a*, 34*a* are laterally spaced from the mouthpiece at both sides of the reeds shank 23 to prevent the ligature from contacting the reed sidewalls 24*a*, 24*b***; and,
3. The opposite ends of both medial spans **32*a*, 34*a* are supported in spaced relation to the subjacent mouthpiece surface by the pads 64*a*, 64*b* whereby these pads serve as pressure pads which accept a portion of the compressive load on the reed shank 23 as the medial spans 34*a*, 34*b*** are drawn resiliently against the shank.

As strap tension increases in response to thumbscrew tightening, a major portion of each of the medial spans **32*a* and 34*a* is drawn into contact with the reed surface 28 along transverse pressure zones underlying these straps. Due to the inherent flexibility and elasticity of the ligature material, the straps 32, 34 do not clamp the reed shank 23 rigidly to the flat mounting surface 26, as do their metallic counterparts; instead, and in accordance with this invention, the reed shank is biased by spans 32***a*, 34*a* against the mouthpiece in a manner that resembles the resilient embrace of a string ligature. Not only do the physical characteristics of the plastic medial spans provide a degree of string-like resiliency; but, the aforedescribed pressure pads 62*a*, 62*b* tend to forestall the creation of excessive sound distorting or deadening pressure acting upon the reed shank in the pressure zones underlying the spaced spans 32*a*, 34*a*. Furthermore, the utilization of a single thumbscrew to tighten a pair of straps distributes the tensile stress between the strap portions 32*a* and 34*a*; and, radial compression applied to the reed shank 23 in the longitudinally spaced pressure zones is similarly shared or balanced. Such beneficial distribution of forces acting on the reed shank is achieved by correctly selecting the lengths of the rings 32, 34 and the angularity or slope of the arms 32*b*, 32*c* and 34*b*, 34*c* of these rings to conform to the tapered shape of the mouthpiece 11 while producing substantially the same tensile stress in the medial strap portions 32*a* and 34*a*. Also to this end, the degree of elasticity displayed throughout the ligature structure tends to equalize the stresses in its side and medial strap portions thereby accommodating slight variations found in the shapes and sizes of a given mouthpiece type.

To obviate the tendancy of a pliant ligature to deaden desirable resonances and harmonics leading to the production of an overly dark, dull tone, the aggregate surface contact area between the present ligature's vibration absorbent plastic body and the mouthpiece and reed has been limited by the following specific means:

1. Generously sized ports 58*a*, 58*b* and 60 open through the ligature body between the straps 32 and 34;
2. Bridges 56*a*, 56*b* and portions of the strap pairs 32*b*, 32*c* and 34*b*, 34*c* are held out of bearing contact with the mouthpiece 11 by the projecting pads 62*a*, 62*b*;
3. The elongated side walls of the pads 62*a*, 62*b* straddling the reed shank 23 are laterally spaced from the sides 24*a*, 24*b* of the shank; and,
4. The strap's medial spans 32*a*, 34*a* are given a workable cross section consistant with the need to prevent their undue or permanent deformation and also consistant with the need that the pressure zones established thereby be of sufficient area to avoid highly localized constraints on reed vibration leading to the production of thin, reedy tones.

From the foregoing description and explanation of the subject ligature and its operation, it may be appreciated that the primary goal of producing string ligature tonal characteristics with a split ring-thumbscrew ligature has been achieved by the cumulative effects and beneficial interactions of the aforenoted structural features of the ligature, namely:

1. The split rings 32, 34 are fabricated of a pliable, resilient material;
2. The tension generated by the operation of the single thumbscrew 44 is distrubuted in a substantially equal manner by the pliant split rings to the reed shank in two spaced pressure zones;
3. The pliant embrace of the split rings biases the reed shank against the mouthpiece rather than clamping it rigidly;
4. Actual pressure contact between the ligature and the reed shank occurs over most of the available surface of the front and rear medial strap portions whereby the unit pressures in the underlying pressure zones are held to a practical minimum;
5. The elongated lugs 62*a*, 62*b* comprise pressure pads which are intended to accept a portion of the compressive loading which would otherwise be imparted to the reed shank; and, thereafter, these pads distribute this load directly to the mouthpiece; and,
6. Excessive damping of desirable reed and mouthpiece vibration is avoided by the windowed configuration of the ligature body and by the provisions of pads 62*a*, 62*b* straddling the reed and functioning to space the ligature straps from the reed shank and the mouthpiece.

The union of these listed features provides a split ring ligature which satisfies each of the five criteria set forth earlier in this specification; and, in the opinion of those instrumentalists who have used this ligature, the tonal qualities formerly associated only with string wound ligatures are achieved to a surprising degree.

It should be understood that the pliable material to be used in the disclosed ligature construction can be varied within the scope of the present invention so long as the selected material is compatible with the design requirements set forth. Other variations of the specific construction and arrangement of the ligature elements disclosed herein can be made by those skilled in the relevant art without departing from the scope of the invention defined in the appended claims.

What is claimed is:

1. A split ring ligature for a woodwind instrument comprising:

a pair of pliable straps each of which comprises a medial span and arm portions which are attached to said span and which extend therefrom;

tightening means operable to draw said straps radially inwardly to embrace compressively the underlying surfaces of a mouthpiece and a reed;

a pair of transversly spaced apart bridge members extending longitudinally between and joining said medial spans of said straps;

pad means projecting radially inwardly from the surface of each bridge member; and said pad means extending in spaced relation to the opposite sides of said reed into compressive engagement with said mouthpiece.

2. The invention according to claim 1, wherein:

each of said pads comprises a single, elongated lug.

3. The invention according to claim 2, wherein:

said lug has a longitudinal dimension no less than that of said bridge member from which it projects.

4. The invention according to claim 3, wherein:

said lug has a rectilinear cross section.

5. The invention according to claim 1, wherein:

said pad means project from said bridge member to such an extent that some part of each strap arm is radially spaced from said mouthpiece surface.

6. The invention according to claim 1, wherein:

to the exclusion of all other ligature surfaces, longitudinally spaced apart flat surfaces defined by said medial spans embrace said reed.

7. The invention according to claim 6, wherein:

said arms have joined distal ends which carry a single strap tightening means; and, said strap arms have slopes and lengths selected to cause said surfaces of said medial spans to embrace said reed with substantially equal pressure.

8. The invention according to claim 6, wherein:

said medial spans consist of plastic material; and, said material has physical properties and said medial spans have cross sectional dimensions which together provide said medial spans a degree of resiliency when said straps are tightened.

* * * * *